US007469744B2

(12) United States Patent
Ruddock et al.

(10) Patent No.: US 7,469,744 B2
(45) Date of Patent: Dec. 30, 2008

(54) DEFORMABLE BALL SEAT AND METHOD

(75) Inventors: David B. Ruddock, Pearland, TX (US); Raymond D. Chavers, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/684,444

(22) Filed: Mar. 9, 2007

(65) Prior Publication Data

US 2008/0217025 A1 Sep. 11, 2008

(51) Int. Cl.
*E21B 34/12* (2006.01)

(52) U.S. Cl. ..... 166/242.1; 166/386; 166/318

(58) Field of Classification Search ..... 166/242.1, 166/316, 318, 319, 383, 386
See application file for complete search history.

(56) References Cited

U.S. PATENT DOCUMENTS

| | | | | |
|---|---|---|---|---|
| 3,211,232 | A | 10/1965 | Grimmer | |
| 4,390,065 | A | 6/1983 | Richardson | |
| 5,960,881 | A * | 10/1999 | Allamon et al. | 166/291 |
| 6,530,574 | B1 * | 3/2003 | Bailey et al. | 277/314 |
| 6,866,100 | B2 * | 3/2005 | Gudmestad et al. | 166/316 |
| 6,896,049 | B2 | 5/2005 | Moyes | |
| 2005/0205264 | A1 | 9/2005 | Starr et al. | |
| 2007/0029080 | A1 | 2/2007 | Moyes | |

FOREIGN PATENT DOCUMENTS

| | | |
|---|---|---|
| WO | 02 068793 | 9/2002 |
| WO | 2004 088091 | 10/2004 |

OTHER PUBLICATIONS

International Search Report with Written Opinion, Application No. PCT/US2008/050223, Date mailed May 8, 2008.

Smith, K.L., et al. "Ultra-Deepwater Production Systems Technical Progress Report." U.S. Department of Energy, Science and Technical Information. Annual Technical Progress Report: Jan. 2005, p. 24 of 36. Retrieved online on Jun. 23, 2008 from: http://www.osti.gov/bridge/servlets/purl/896670-oSYLXW/896670.PDF.

Smith, K., et al. "Close Tolerance Liner Drilling and Requirements for Deepwater Applications." Offshore Technology Report. World Oil Magazine online: Jul. 2004, p. 7 of 11. Retrieved on Jun. 23, 2008 from http://www.compositecatalog.com/magazine/MAGAZINE_DETAIL.asp?ART_ID=2343&MONTH_YEAR=Jul-2004.

Baker Oil Tools, "Coiled Tubing Solutions: Solving Downhole Problems with Reliable, Cost-Effective Technology." Baker Hughes, Incorporated: Pub. No. BOT-02-9242. Jul. 2003, p. 60.

* cited by examiner

*Primary Examiner*—Jennifer H Gay
*Assistant Examiner*—Daniel P Stephenson
(74) *Attorney, Agent, or Firm*—Cantor Colburn LLP

(57) ABSTRACT

Disclosed herein is a disappearing ball seat. The disappearing ball seat includes, a tubular member having an inside dimension, and a restricted dimension portion of the tubular member dimensioned to prevent passage of a tripping ball therethrough, the restricted dimension portion being reconfigurable to a dimension capable of passing the tripping ball therethrough.

2 Claims, 2 Drawing Sheets

DEFORMABLE BALL SEAT AND METHOD

BACKGROUND OF THE INVENTION

It is common practice to actuate various downhole tools in a wellbore by pressuring up from the surface to effect the actuation. In some cases a ball seat and ball are used to shut off the bore downhole of a tool that is to be actuated. This enables the operator to pressure up on the portion of the well uphole of the ball and seat, thereby effecting the pressure actuation of the target tool. After the tool has been actuated it may be desirable to reopen the bore where the ball and seat are located so as not to obstruct production flow from the well, for example.

Systems have been developed in which a deformable ball such as an elastomeric ball, for example, is dropped onto a seat for the actuation and then can be pushed through the seat upon an increase in the hydraulic pressure from above. In order to accomplish this result the ball is deformed. The ball must therefore be carefully engineered to hold pressure at a level calculated to facilitate the desired actuation and then deform at a selected higher pressure deliverable selectively from uphole. Once the ball is through the seat it can fall to the bottom of the wellbore, for example, leaving the seat inside dimension open. In such cases, however, the restricted diameter seat, upon which the ball was seated, remains in the wellbore forming a diametrical restriction in the wellbore that can have a detrimental affect on subsequent operations or, for example, production flows. It would, therefore, be desirable in the art to have a system allowing the simple removal of all restrictions in the wellbore subsequent to actuation of a tool.

BRIEF DESCRIPTION OF THE INVENTION

Disclosed herein is a disappearing ball seat. The disappearing ball seat includes, a tubular member having an inside dimension and a restricted dimension portion of the tubular member dimensioned to prevent passage of a tripping ball therethrough, the restricted dimension portion being reconfigurable to a dimension capable of passing the tripping ball therethrough.

Further disclosed herein is a method for facilitating operations in a wellbore. The method includes dropping a tripping ball to a restricted dimension portion of a tubular member, pressuring up to a first selected pressure on the ball to actuate a pressure actuated well process, and pressuring to a second selected pressure to reconfigure the restricted dimension portion of the tubular member to a position capable of passing the ball therethrough.

Further disclosed herein is a method for facilitating operations in a wellbore. The method includes dropping a tripping ball to a restricted dimension portion of a tubular member, pressuring up to a selected pressure on the ball to actuate a pressure actuated well process, and applying a tensile load to the tubular member to reconfigure the restricted dimension portion of the tubular member to a position capable of passing the ball therethrough.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of several embodiments of the disclosed apparatus and method are presented herein by way of exemplification and not limitation with reference to the Figures.

Figure 1:
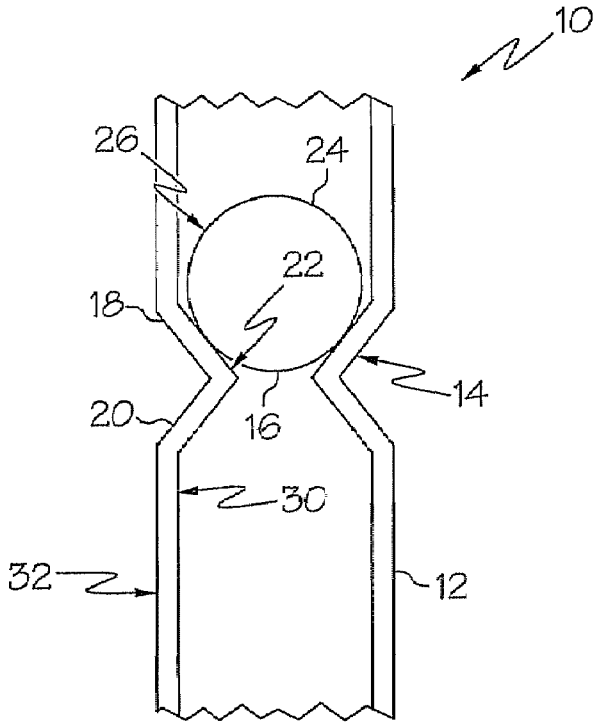
FIG. 1 depicts a tubular member with an actuated restricted inside dimension ball seat as disclosed herein.

Referring to FIG. 1 an embodiment of the disappearing ball seat system 10 is illustrated. The system 10 includes a tubular member 12 and a reconfigurable seat portion 14. As illustrated in FIG. 1, the seat portion 14 is actuated such that a restricted dimension axial passageway 16 is created. Uphole and downhole of the passageway 16 are frustoconical sections 18 and 20. The uphole frustocone 18 presents a surface 22 that is interactive with a tripping ball 24, when such ball of an appropriate external dimension (larger than the inside dimension of the ball seat 14) is dropped onto the seat 14. The tripping ball 24 may be made of such materials as metal, ceramic and polymer, for example, such that the tripping ball 24 holds its shape and is substantially nondeformable. The ball 24 may be dropped, pumped or gravitated to the valve seat 14 from the surface or other remote location. Interaction between the surface 22 and an exterior surface 26 of ball 24 significantly restricts flow of a fluid through the passageway 16 in a direction that would encounter the ball 24 before the seat 14. This allows for pressuring up on the wellbore uphole of the seat 14 when a ball 24 is in place.

Figure 2:
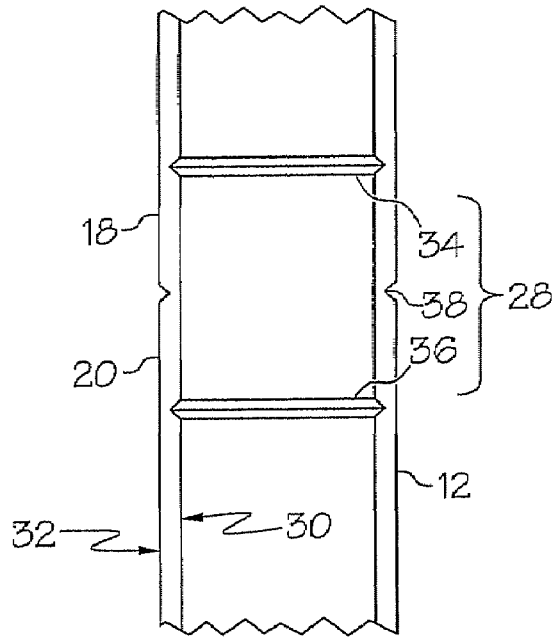
FIG. 2 depicts the tubular member with the restricted dimension ball seat of FIG. 1 in a nonactuated configuration.

The disappearing ball seat system 10 has the further capability however of allowing the ball seat 14 to be reconfigured. More specifically, and referring to FIG. 2, the ball seat 14 may be reconfigured to open the full bore of the tubular member 12. In such configuration, the frustocones 18 and 20 are reconfigured as roughly cylindrical components having roughly the same inside dimension (or greater) as the tubular member 12 uphole and downhole thereof. Reconfiguration is effected, in one embodiment, by the application of an axial tensile load on the tubular member 12. In an alternate embodiment reconfiguration is effected by the application of hydraulic pressure from uphole, for example, to at least a preset level that is adequate to force the ball 24 against the surface 22 with sufficient force to open the restricted dimension axial passageway 16 to a dimension able to pass the nondeformed ball 24 therethrough. In so doing the ball seat 14 is reconfigured to the position shown in FIG. 2 elongating the tubular member 12 in the process.

Reconfigurability of the tubular member 12 to the position presenting the ball seat 14 and to the position presenting little or no restriction in the tubular member 12 is due to the construction thereof. The seat 14 (FIG. 1) is formed from a section of the tube 28 that has three lines of weakness, specifically located both axially of the tubular member and with respect to inside surface 30 and outside surface 32 of the tubular member 12. In one embodiment, a first line of weakness 34 and a second line of weakness 36 are defined in this embodiment by diametrical grooves formed in the inside surface 30 of the tubular member 12. A third line of weakness 38 is defined in this embodiment by a diametrical groove formed in an outside surface 32 of the tubular member 12. The three lines of weakness 34, 36, and 38 each encourage local deformation of the tubular member 12 in a radial direction that tends to cause the groove to close. It will be appreciated that in embodiments where the line of weakness is defined by other than a groove, the radial direction of movement will be the same but since there is no groove, there is no "close of the groove". Rather, in such all embodiment, the material that defines a line of weakness will flow or otherwise allow radial movement in the direction indicated. The three lines of weakness together encourage deformation of the tubular member 12 in a manner that creates a feature such as the ball seat 14. The feature is created, then, upon the application of an axially directed mechanical compression of the tubular member 12 such that the ball seat 14 is formed as the tubular member 12 is compressed to a shorter overall length. Other mechanisms can alternatively be employed to actuate the tubular member 12 between the nonactuated relatively cylindrical configuration and the configuration presenting the ball seat 14. For example, the tubular member may be reconfigured to the ball seat position by diametrically compressing the tubular member 12 about the outer surface 32 in the section of weakness 28, for example.

Figure 3:
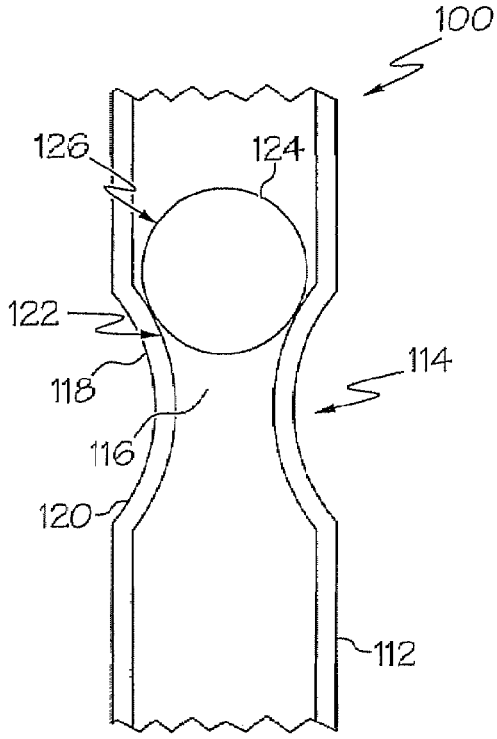
FIG. 3 depicts a tubular member with an actuated arcuate restricted dimension ball seat disclosed herein.

Referring to FIG. 3 an alternate exemplary embodiment of a disappearing ball seat system 100 is illustrated. The system 100 includes a tubular member 112 and a reconfigurable seat portion 114. As illustrated in FIG. 3, the seat portion 114 is actuated such that a restricted dimension axial passageway 116 is created. Uphole and downhole of the passageway 116 are arcuate sections 118 and 120. The uphole arcuate section 118 presents a surface 122 that is interactive with a tripping ball 124, when such ball of an appropriate external dimension (larger than the inside dimension of the ball seat 114) is dropped onto the seat 114. The tripping ball 124 may be made of such materials as metal, ceramic and polymer, for example, such that the tripping ball 124 holds its shape and is substantially nondeformable. The ball 124 may be dropped, pumped or gravitated to the valve seat 114 from the surface. Interaction between the surface 122 and an exterior surface 126 of ball 124 significantly restricts flow of a fluid through the passageway 116 in a direction that would encounter the ball 124 before the seat 114. This allows for pressuring up on the wellbore uphole of the seat 114 when a ball 124 is in place.

Figure 4:
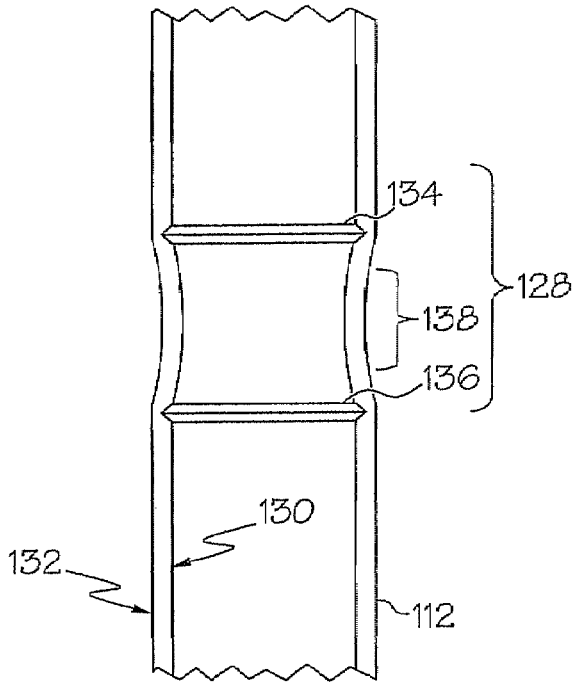
FIG. 4 depicts the tubular member with the arcuate restricted dimension ball seat of FIG. 3 in a nonactuated configuration.

The disappearing ball seat system 100 has the further capability however of allowing the ball seat 114 to be reconfigured. More specifically, and referring to FIG. 4, the ball seat 114 may be reconfigured to open the full bore of the tubular member 112. In such configuration, the arcuate sections 118 and 120 are reconfigured as roughly cylindrical components having roughly the same inside dimension (or greater) as the tubular member 112 uphole and downhole thereof. Reconfiguration is effected, in one embodiment, by the application of an axial tensile load on the tubular member 112. In an alternate embodiment reconfiguration is effected by the application of hydraulic pressure from uphole, for example, to at least a preset level that is adequate to force the ball 124 against the surface 122 with sufficient force to open the passageway 116 to a dimension capable of passing the nondeformed ball 124 therethrough. In so doing the ball seat 114 is reconfigured to the position shown in FIG. 4 elongating the tubular member 112 in the process.

Reconfigurability of the tubular member 112 to the position presenting the ball seat 114 and to the position presenting little or no restriction in the tubular member 112 is due to the construction thereof. The seat 114 (FIG. 3) is formed from a section of the tube 128 that has lines and areas of weakness, specifically located both axially of the tubular member 112 and with respect to inside surface 130 and outside surface 132 of the tubular member 112. In one embodiment, a first line of weakness 134 and a second line of weakness 136 are defined in this embodiment by diametrical grooves formed in the inside surface 130 of the tubular member 112. An area of weakness 138 is defined in this embodiment as the area between the lines of weakness 134 and 136. The lines of weakness 134, 136, and area of weakness 138 encourage local deformation of the tubular member 112 in a radial direction that tends to cause the groove to close. It will be appreciated that in embodiments where the line of weakness is defined by other than a groove, the radial direction of movement will be the same but since there is no groove, there is no "close of the groove". Rather, in such an embodiment, the material that defines a line of weakness will flow or otherwise allow radial movement in the direction indicated. The lines and area of weakness together encourage deformation of the tubular member 112 in a manner that creates arcuate sections 118 and 120 of the ball seat 114. The feature is created, then, upon the application of an axially directed mechanical compression of the tubular member 112 such that the ball seat 114 is formed as the tubular member 112 is compressed to a shorter overall length. Other mechanisms can alternatively be employed to actuate the tubular member 112 between the nonactuated relatively cylindrical configuration and the configuration presenting the ball seat 114. For example, the tubular member may be reconfigured to the ball seat position by diametrically compressing the tubular member 112 about the outer surface 132 in the section of weakness 128, for example.

Although embodiments disclosed herein of restricted dimensioned valve seats have been formed symmetrically over the length of the tubular members 12, 112 it should be understood that alternate embodiments with nonsymmetrical restricted dimensioned areas could also be employed. Additionally, the lines of weakness 34, 36, 38, 134, 136 and areas of weakness 138 disclosed herein could tale the form of various configurations, such as, different materials, or material properties, for example, while still remaining within the spirit and scope of the present invention.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A method for facilitating operations in a wellbore comprising:

dropping a tripping ball to a restricted dimension portion of a tubular member;

pressuring up to a selected pressure on the ball to actuate a pressure actuated well process; and applying a tensile load to the tubular member to reconfigure the restricted dimension portion of the tubular member to a position capable of passing the ball therethrough.

2. The method for facilitating operations in a wellbore of claim 1 wherein the applying a tensile load to the tubular member includes at least one of applying hydraulic pressure and applying mechanical forces.

* * * * *